United States Patent [19]

Smyth, Jr.

[11] Patent Number: 4,612,796

[45] Date of Patent: Sep. 23, 1986

[54] HYDRAULICALLY ACTUATED TOOLING CLAMPS FOR THE RAM AND BED OF A PRESS BRAKE AND THE LIKE

[75] Inventor: Dale C. Smyth, Jr., Lawrenceburg, Ind.

[73] Assignee: Cincinnati Incorporated, Cincinnati, Ohio

[21] Appl. No.: 590,517

[22] Filed: Mar. 15, 1984

[51] Int. Cl.[4] ..... B21D 37/04

[52] U.S. Cl. ..... 72/481; 72/462; 72/465; 72/389; 403/5; 403/15

[58] Field of Search ..... 72/389, 465, 462, 481; 403/15, 16, 5

[56] References Cited

U.S. PATENT DOCUMENTS

| | | | |
|---|---|---|---|
| 2,959,258 | 11/1960 | Hagemann | 403/15 |
| 3,596,944 | 8/1971 | Ecker et al. | 403/15 |
| 4,315,425 | 2/1982 | Zbornik et al. | 72/389 |

FOREIGN PATENT DOCUMENTS

| | | | |
|---|---|---|---|
| 180067 | 2/1966 | U.S.S.R. | 72/481 |

OTHER PUBLICATIONS

Cincinnati Mechanical Press Brakes, 12/28/59, pp. 21, 37 and 43.

*Primary Examiner*—Francis S. Husar
*Assistant Examiner*—David B. Jones
*Attorney, Agent, or Firm*—Frost & Jacobs

[57] ABSTRACT

Tooling clamps by which tooling having mounting tongues can be attached to and detached from the working edges of the ram and bed of a press brake. Each clamp comprises a clamp body affixed to the working edge of one of the ram and bed. The clamp body provides a clamping surface. The clamp body supports a plurality of clamping bars aligned end-to-end. Each clamping bar has a clamping surface opposed to the clamp body clamping surface. Each clamping bar is affixed to the body by bolts which pass through perforations in the clamp body with clearance, so that each clamping bar is shiftable between a tool-clamping and a tool-release position. Spring means bias the clamping bars to their tool-clamping positions. A housing is affixed to the rear of the clamp body and extends the length thereof. The housing has a longitudinal cavity containing an actuating bar in abutment with the heads of the clamping bar bolts and a high pressure hose. When the hose is filled with hydraulic fluid under pressure, it expands, shifting the actuating bar against the bolt heads, the bolt heads against the action of their spring means, and the clamping bars to their tool-release positions, permitting a tooling tongue to be inserted between the clamping surfaces. When hydraulic fluid is drained from the hose, it will contract, causing the tooling clamp to return to its normal clamping condition and the tooling tongue to be firmly clamped.

10 Claims, 6 Drawing Figures

HYDRAULICALLY ACTUATED TOOLING CLAMPS FOR THE RAM AND BED OF A PRESS BRAKE AND THE LIKE

TECHNICAL FIELD

The invention relates to means for attaching conventional tongued tooling to the ram and bed of a press brake and the like, and more particularly to hydraulically actuated clamping means for this purpose, by which the tooling can be attached and detached from the bed and ram quickly and easily, the clamping means being normally mechanically biased to their clamping condition, and hydraulically actuated to their unclamping condition.

BACKGROUND ART

While the clamps of the present invention may find application wherever one element is to be mounted on another by a clamping action, they are particularly well adapted for mounting the tooling on the ram and bed of a press brake. Therefore, for purposes of a non-limiting exemplary showing, the clamps of the present invention will be described in association with the ram and bed of a press brake.

With the exception of adjustable female dies, multiple groove dies and the like, most dies used on a press brake are provided with longitudinally extending tongues by which they are clamped to the ram and bed of the press brake. Exemplary dies of this type include acute angle dies, bottoming dies, flattening dies, air bend dies, gooseneck dies, radius dies, offset dies, beading dies, and many dies for special shapes.

In a typical prior art arrangement, the ram working edge is configured to present a forward facing clamping surface. The ram working edge is further configured to accommodate one or more longitudinally extending clamping bars. When more than one clamping bar is provided, they are arranged along the ram working edge in end-to-end alignment. The clamping bars provide a rearwardly facing clamping surface. The clamping bar or bars are adjustably affixed to the ram by bolts. The rearwardly facing clamping surface of the bars and the forwardly facing clamping surface of the ram edge define a slot of adjustable width into which the tongue of an appropriate die can be located and clamped by tightening of the clamping bar bolts.

In the most usual practice, the working edge of the press brake bed has a filler block appropriately mounted thereon and extending longitudinally thereof. The filler block provides a longitudinal groove in its upper surface adapted to receive the tongue of an appropriate die to be mounted on the bed. The filler block is provided with a plurality of transversely extending set screws, communicating with the filler block slot and adapted to be tightened against the die tongue located in the filler block slot to clamp the tooling therein. It will be immediately evident that the mounting and dismounting of dies from the press brake ram and bed, and the changeover from one die set to another, constitute time consuming and difficult operations.

The present invention is based upon the discovery that if the ram and bed are provided with hydraulically actuated clamping means, the mounting and dismounting of dies, and the changeover from one die set to another, can be accomplished quickly, easily and accurately. The clamps of the present invention are extremely simple in construction. The clamp for the press brake bed also serves as a filler block. The clamp for the ram is preferably an integral part of the ram. The ram clamp, on the other hand, can be a separate member attachable to the ram, for use on already existing press brakes.

A fundamental advantage of the clamping means of the present invention lies in the fact that they are mechanically biased to their clamping condition and hydraulically actuated to their unclamping condition. Thus, a failure in the hydraulic system cannot surprisingly release the tooling resulting in injury to the operator or damage to the press brake, the tooling, or the workpiece. Furthermore, hydraulic pressure need not be maintained during normal operation of the press brake, which is costly. Hydraulic pressure need only be maintained when tooling is released for changing.

DISCLOSURE OF THE INVENTION

According to the invention, tooling clamps are provided by which dies or other appropriate tooling having mounting tongues can be easily and quickly attached to and detached from the working edges of the ram and bed of a press brake. The tooling clamps for the ram and for the bed are similar in construction. Each of the tooling clamps comprises a clamp body affixable to its respective one of the ram and bed, and extending substantially the length thereof. The clamp body provides a forward facing clamping surface. The clamp body supports a plurality of clamping bars aligned thereon in end-to-end relationship and extending substantially the length of the clamp body. Each clamping bar has a clamping surface facing rearwardly and opposed to the clamp body clamping surface.

Each of the clamping bars is affixed to its respective clamp body by bolts which pass through perforations in the clamp body with clearance so that each clamping bar is shiftable with respect to its clamp body between a closed or tool-clamping position and an open or tool-release position. Spring means are provided to bias each of the clamping bars to its tool-clamping position.

A housing member is affixed to the rear of each clamp body and extends substantially the length thereof. The housing member has a longitudinal cavity formed therein containing an actuating bar. The actuating bar extends the length of the housing member and lies in abutment with the heads of all of the clamping bar bolts. The clamping bar is shiftable in a direction transverse its long axis. The housing member cavity also contains a high pressure hose located on that side of the actuating bar opposite the side abutting the clamping bar bolts.

The parts are so arranged that when the hose is filled with a fluid medium under pressure, the hose expands, shifting the actuating bar against the clamping bar bolt heads. This action, in turn, shifts the bolts against the action of the above mentioned spring means and the clamping bars to their open or tool-release position. When the clamping bars are in their release position, a tooling tongue can be inserted between the clamping surfaces of the clamping bars and the clamp body. When fluid medium under pressure is no longer fed through the hose, the spring means will return the clamping bars to their tool tongue-clamping positions and the tooling will be firmly engaged by the clamp. Return of the clamping bars to their tool tongue-clamping positions will cause the clamping bar bolt heads to shift the actuating bar rearwardly, collapsing the high pressure hose.

Each hose for each tool clamp does not serve simply as a fluid transmitting means. Each hose, itself, constitutes the tool clamp actuating means, actuating the tool clamp to its unclamped condition.

DETAILED DESCRIPTION OF THE INVENTION

Figure 1:
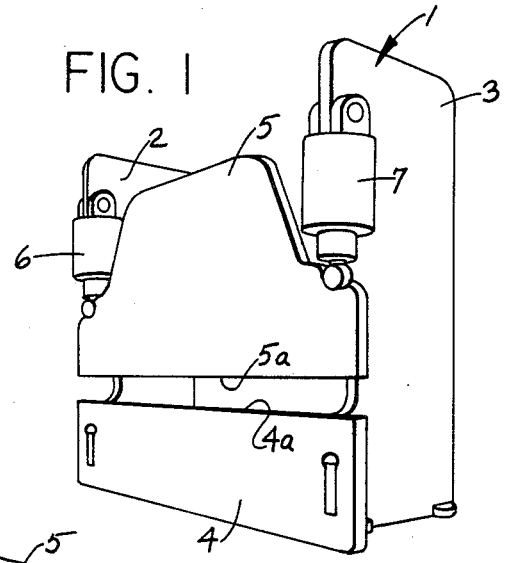
FIG. 1 is a simplied perspective view of an exemplary press brake.

Referring first to FIG. 1, this Figure is a simplied perspective view of a hydraulic press brake. It will be understood by one skilled in the art that the teachings of the present invention are not limited to hydraulic press brakes. When the teachings of the present invention are applied to a mechanical press brake, it will be necessary to provide a separate source of fluid under pressure.

The press brake of FIG. 1 is generally indicated at 1 and comprises a pair of upstanding housings or side frames 2 and 3. The press brake bed 4 is supported by housings 2 and 3. Press brake ram 5 is supported in ways on the housings 2 and 3. The bed 4 has a working edge 4*a* and the ram 5 has an opposed working edge 5*a*. The ram 5 is vertically shiftable toward and away from the bed 4 by a pair of main hydraulic cylinders 6 and 7. One skilled in the art will understand that the press brake 1 will be provided with an appropriate source of hydraulic fluid, one or more hydraulic pumps, appropriate hydraulic circuitry, control means and various safety features, all of which are not shown and do not constitute a part of the present invention.

Figure 2:
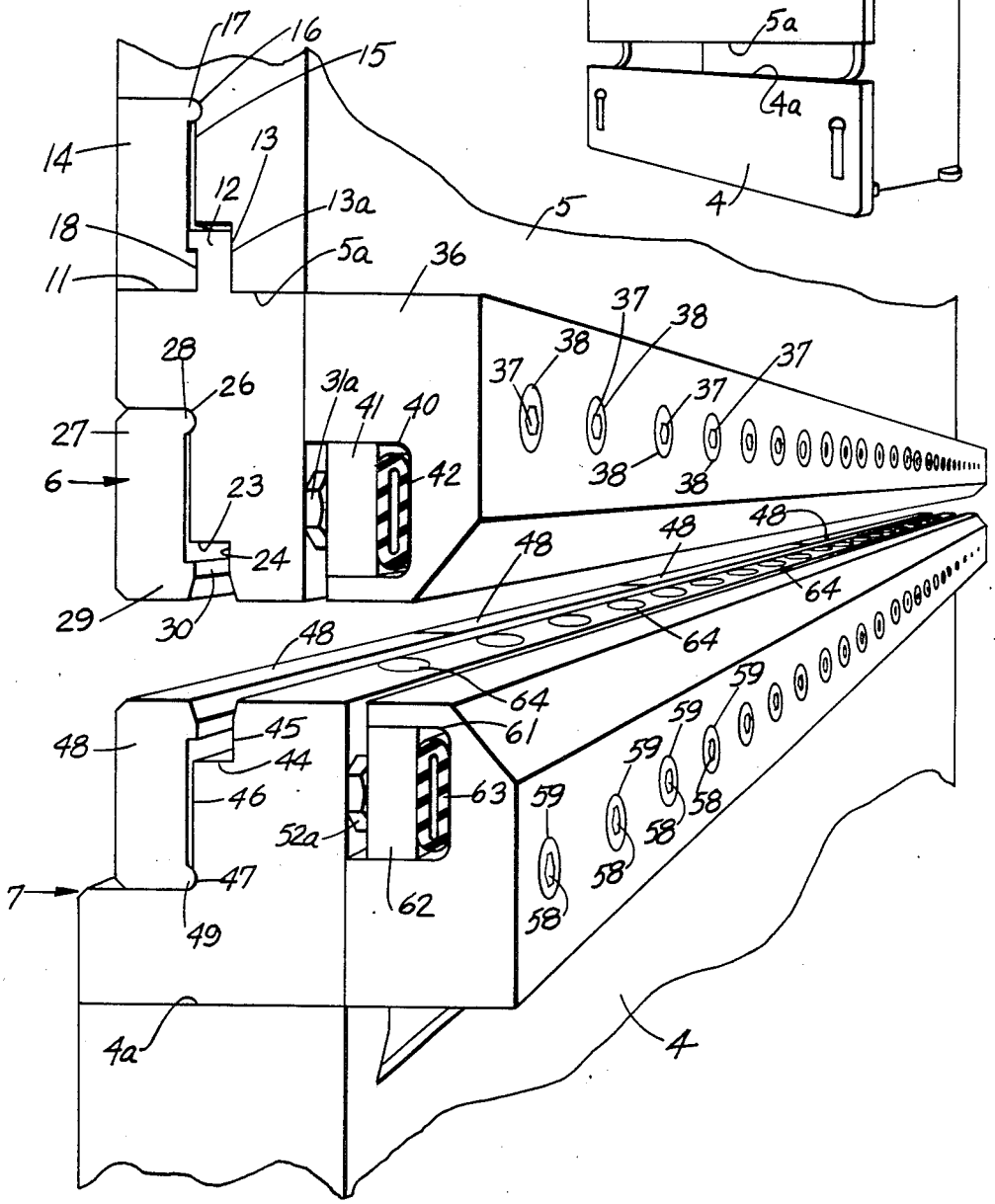
FIG. 2 is a fragmentary perspective view of the ram and bed of the press brake of FIG. 1, provided with the tooling clamps of the present invention.
Figure 3:
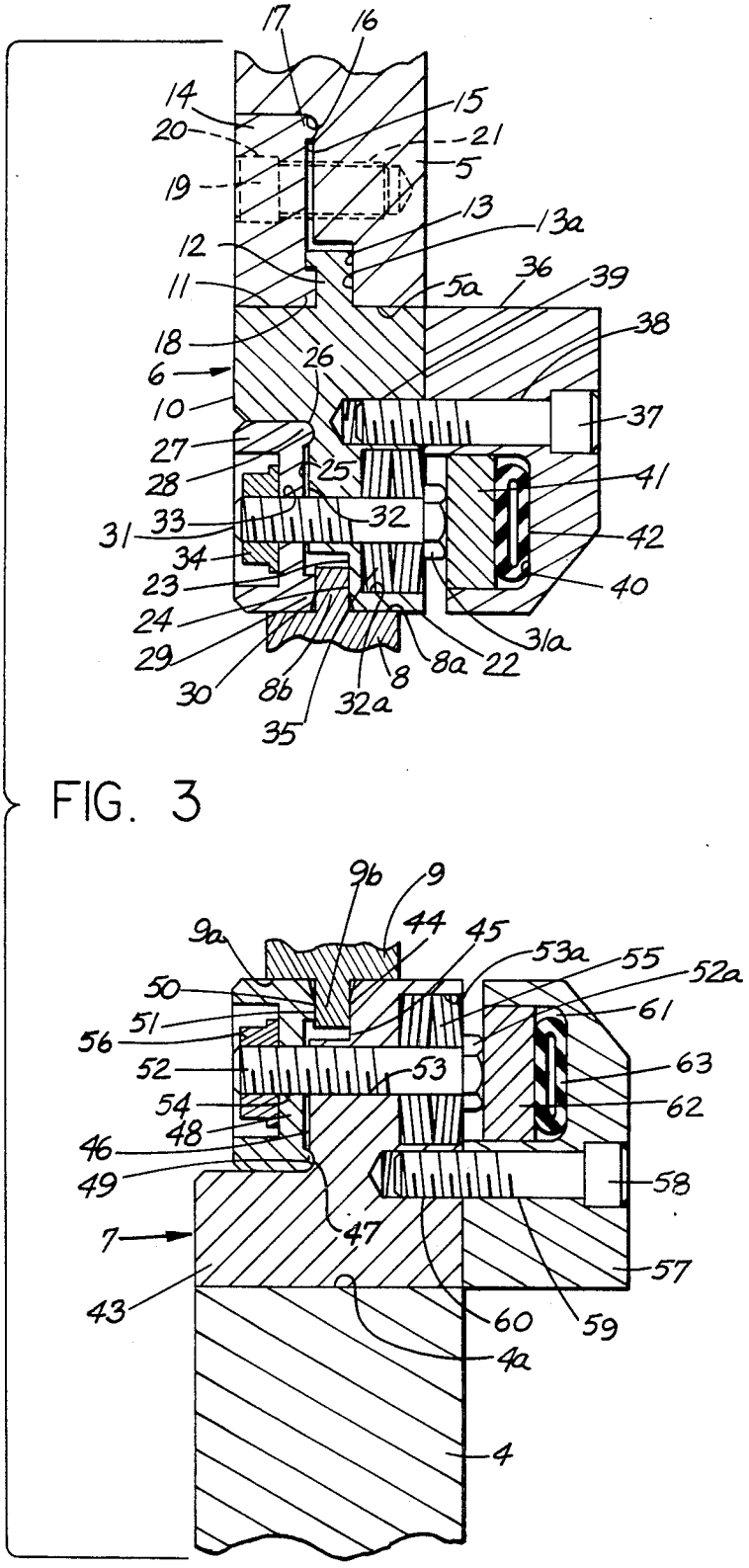
FIG. 3 is a fragmentary cross-sectional view through the ram, the bed and the clamps of the present invention, illustrating the clamping bars in their tool-clamping positions.

Reference is now made to FIGS. 2 and 3, wherein like parts have been given like index numerals. In FIGS. 2 and 3, ram 5 and bed 4 are fragmentarily shown. The tool clamp for ram 5 is generally indicated at 6, the tool clamp for bed 4 is generally indicated at 7. A die 8 is fragmentarily shown mounted on ram 5, and a die 9 is similarly fragmentarily shown mounted on bed 4. The nature of dies 8 and 9 does not constitute a limitation on the present invention. While not always the case, generally the die 8 is a female die and the die 9 is a male die. As is conventional, the rearward surface 8*a* of die 8 is substantially planar and has a tongue 8*b* extending centrally therefrom and longitudinally thereof. In similar fashion, the rear surface 9*a* of die 9 is substantially planar, having a tongue 9*b* extending centrally therefrom and longitudinally thereof.

The tooling clamp 6, for ram 5, comprises a clamp body 10. Preferably, the clamp body 10 constitutes an integral, one-piece part of ram 5. In FIGS. 2 and 3, however, it is shown as a separate element releasably attachable to the working edge 5*a* of ram 5. This is true because the tool clamp 6 of the present invention could be applied to existing press brakes.

To this end, the clamp body 6 extends substantially the length of the working edge 5*a* of ram 5 and has a planar bottom surface 11 from which an inverted L-shaped, or hook-shaped, tongue 12 extends. The ram 5 is provided with a step or notch 13, the vertical surface 13*a* of which constitutes a clamping surface. The ram 5 supports a plurality of substantially identical clamping bars arranged in end-to-end relationship along the ram. One such clamping bar is shown at 14. The ram is provided with a step or notch 15, running along its length, to accommodate the clamping bars 14. At the corner of the notch, a rounded depression 16 is provided.

Clamping bar 14 has, along its upper rearward edge, a rounded nose 17, adapted to be received in the rounded depression 16 of ram 5. At its lower rearward edge, the clamping bar 14 is provided with a rearwardly extending flange 18. The clamping bar is affixed to ram 5 by means of two or more bolts, one of which is shown at 19. The bolt 19 passes through a perforation 20 in clamping bar 14 and is threadedly engaged in a perforation 21 in ram 5.

It will be apparent from FIG. 3 that when the tongue 12 of clamp body 10 is located between the clamping surface 13*a* of ram 5 and the lug 18 of clamping bar 14, and when the clamping bar bolts (one of which is shown at 19) are tightened, the tongue 12 will be clamped between ram clamping surface 13*a* and clamping bar lug 18, in addition to a mechanical engagement by clamping bar lug 18. It will be understood that the other clamping bars (not shown) equivalent to clamping bar 14 operate in the same manner. The rounded nose 17 in depression 16 permits clamping bar 14 to rotate about the center of the radius of nose 17 to create a positive moment arm for clamping.

Clamp body 10 provides a planar bottom surface 22 adapted to abut the planar rear surface 8*a* of die 8. The clamp body has a step or notch 23 formed therein and running the length thereof. The notch 23 is similar to notch 13 in ram 5. The notch 23 provides a vertical surface 24 serving as a clamping surface for the tongue 8*b* of die 8. The clamp body 10 has a second larger step or notch 25, similar to notch 15 of ram 5. The right angle corner of notch 25 has a rounded depression 26 formed therein, equivalent to depression 16 of ram 5. The notch 25 is adapted to accommodate a plurality of clamping bars aligned end-to-end along the length of clamp body 10. The clamping bars are identical and one such clamping bar is shown at 27 in FIG. 3. At its upper rearward edge, clamping bar 27 has a rounded nose 28 adapted to engage in the rounded depression 26 of clamp body 10, to serve the same purpose as described with respect to nose 17. At its lower rearward edge, the clamping bar 27 has a lug 29 providing a clamping surface 30, adapted to engage the tongue 8*b* of die 8.

While not intended to be bound by dimensions, the clamping bar 27 can conveniently be made of a length of approximately two feet. Therefore, on an 8-foot ram, there would be four such clamping bars; on a 14-foot ram, there would be seven such clamping bars; and so on.

Each clamping bar 27 is affixed to clamp body 10 in the same manner by at least one bolt, and preferably by at least two bolts, one of which is shown at 31. The bolt 31 passes through a transverse perforation 32 in clamping body 10 with clearance, the perforation 32 having a rearward portion 32*a* of enlarged diameter, the purpose of which will be apparent hereinafter. The bolt 31 passes with clearance through a transverse perforation 33 in the clamping bar 27 and is provided with a nut 34.

The bolt 31 (as is true of all the other clamping bar bolts not shown) is provided with a head 31*a* and supports a plurality of belleville springs 35 located in the large diameter portion 32*a* of perforation 32. Belleville springs 35 abut the clamp body 10 and the head 31*a* of bolt 31, thereby constantly urging clamping bar 27 to its tool-clamping position. It will be understood that all of the clamping bars (not shown), equivalent to clamping bar 27, will be similarly constantly urged to their clamping positions by belleville springs mounted on each of the clamping bar bolts.

To complete the tooling clamp 6, a housing 36 is affixed to the rear surface of clamp body 10 by a plurality of spaced, identical bolts, one of which is shown at 37. The bolt 37 passes through a perforation 38 in housing member 36 and is threadedly engaged in a corresponding perforation 39 in clamp body 10. Housing member 36 extends the length of clamp body 10. A cavity 40 is formed in housing member 36 and extends longitudinally thereof throughout the length of housing member 36.

An actuating bar 41 is located in cavity 40 and extends the length thereof. Actuating bar 41 is shiftable within cavity 40 in a direction perpendicular to its long axis. It will be noted from FIG. 3 that actuating bar 41 lies in abutment with the head 31*a* of bolt 31. Actuating bar 41 will similarly abut the heads of all of the other clamping bar bolts (not shown).

In the space between clamping bar 41 and the rearwardmost surface of cavity 40, a high pressure hose 42 is located. The high pressure hose 42 is connected to a source (to be described hereinafter) of fluid under pressure through a valved control means (to be described hereinafter). While in some light duty applications, the fluid under pressure may be air under pressure, or the like, in a heavy duty application, such as the one being described, the high pressure hose 42 should be connected to a source of hydraulic fluid under pressure.

The tooling clamp 6 having been described in detail, its operation can be set forth as follows. In FIG. 3, the tooling clamp 6 is shown in its normal tool-clamping mode. The high pressure hose 42 is shown in collapsed condition, being disconnected from the source of hydraulic fluid under pressure by the valved control means. As a result, the position of the clamping bar 27 is influenced by belleville springs 35 (the same being true of all of the other clamping bars not shown) and, therefore, the clamping bars are shifted to their normal clamping positions, with the clamping bar lug surface 30 engaging die tongue 8*b*, which is clamped between clamping bar surface 30 and clamp body surface 24.

Figure 4:
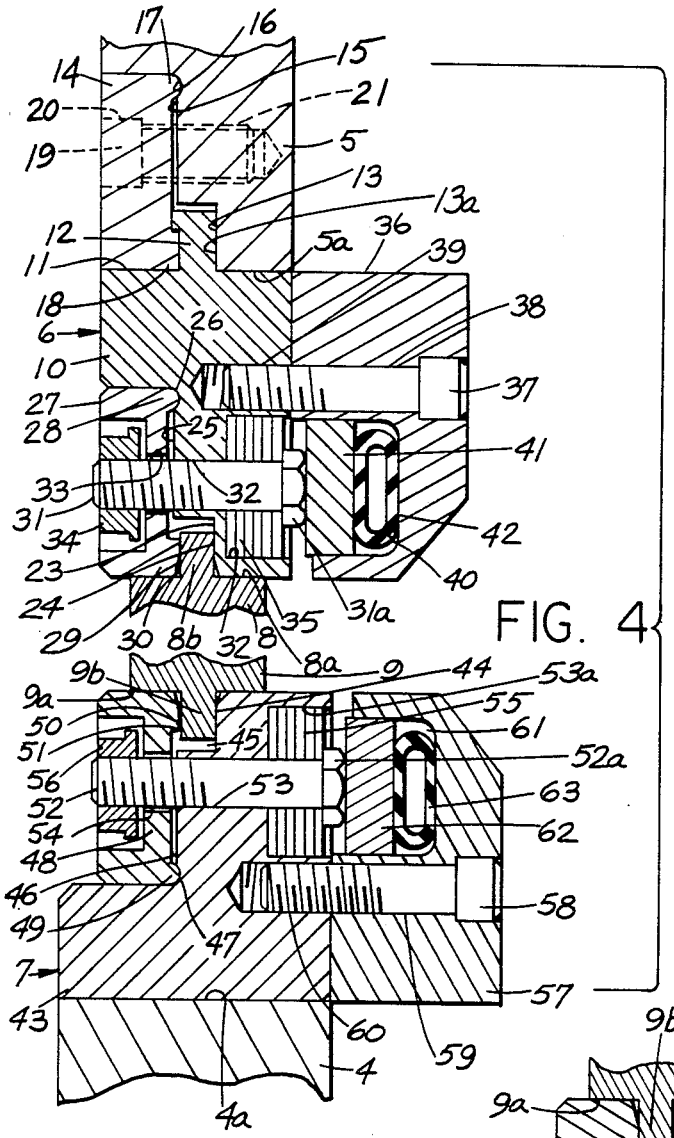
FIG. 4 is a fragmentary cross-sectional view, similar to FIG. 3, and illustrating the clamping bars in their tool-release positions.

When the high pressure hose 42 is connected to hydraulic fluid under pressure by a valved control means, it will expand, as shown in FIG. 4. Expansion of high pressure hose 42 will cause it to shove actuating bar 41 against the head 31*a* of bolt 31 and similarly against the heads of all of the other clamping bar bolts (not shown). This results in belleville springs 35 (and the other sets of belleville springs not shown) being compressed which, in turn, releases clamping bar 27 and the other clamping bars (not shown) to their tool-release positions. At this point, the die 8 can be removed and another die quickly and easily inserted between the clamp body surface 24 and the clamping bar surface 30. Upon release of the hydraulic fluid under pressure within high pressure hose 42 by a valved control means, the belleville springs 35 will cause the bolt 31 to shift the clamping bar 27 back to its normal clamping position, as shown in FIG. 3. The belleville springs associated with the bolts of all the other clamping bars (not shown) will similarly shift all of the other clamping bars to their tool-clamping positions. This will simultaneously cause actuating bar 41 to shift to its position shown in FIG. 3 and the high pressure hose 42 to collapse. As a result, the replacement die will be firmly held by tooling clamp 6.

The tool clamp 7 of bed 4 is substantially identical to tool clamp 6 of ram 5, with the exceptions that the clamp body 43 (equivalent to clamp body 10) is slightly wider to accommodate the additional width of bed 4 and is attached to bed 4 in a different manner, as will be described hereinafter. Tool body 43 has a first step or notch 44 equivalent to the notch 24 of tool body 10 and providing a vertical clamping surface 45. Tool body 43 has a second step or notch 46 equivalent to the notch 25 of tool body 10 and having a rounded depression 47 equivalent to rounded depression 26 of tool body 10.

The notch 46 of tool body 43 accommodates a clamping bar 48, equivalent to clamping bar 27 of clamp 6. To this end, clamping bar 48 has a rounded nose 49 adapted to be received in the rounded depression 47 and a lug 50 providing a clamping surface 51. Rounded nose 49 serves the same purpose described with respect to rounded nose 17. As in the case of clamping bar 27, it will be understood that there will be a plurality of clamping bars 48 arranged in end-to-end relationship and extending the length of clamp body 43 (see FIG. 2). Each clamping bar 48 is connected to clamp body 43 by at least one bolt, and preferably by at least two bolts, one of which is shown at 52. The bolt 52 passes with clearance through a perforation 53 in clamp body 43 and a perforation 54 in clamping bar 48. The clamp body perforation 53 has a portion 53*a* of enlarged diameter to accommodate a series of belleville springs 55, equivalent to belleville springs 35 of tool clamp 6. The bolt 52 is threadedly engaged in a nut 56 at one end and is provided with a head 52*a* at its other end. It will be understood that all of the bolts of all of the clamping bars will be similarly arranged and provided with belleville springs.

The tool clamp 7 is provided with a housing member 57 identical to housing member 36 described above. The housing 57 extends the length of clamp body 43 and is affixed to the rear surface thereof by a plurality of bolts, one of which is shown at 58. The bolt 58 passes through a perforation 59 in housing member 57 and is threadedly engaged in a corresponding perforation 60 in clamp body 43. Housing member 57 has a cavity 61 extending throughout its length. An actuating bar 62 is mounted within cavity 61 and is the full equivalent of actuating bar 41. Also within cavity 61 there is mounted a high pressure hose 63, identical to high pressure hose 42. High pressure hose 63 will be connected to a source (described hereinafter) of hydraulic fluid under pressure through a valved control means (described hereinafter).

Figure 5:
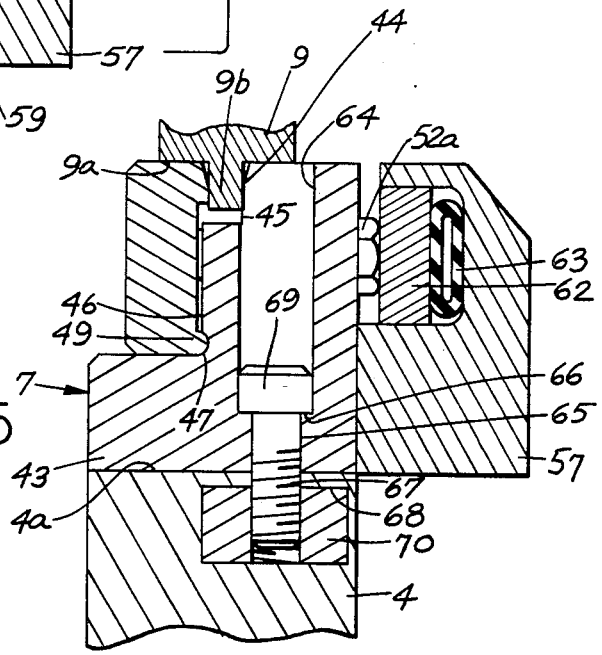
FIG. 5 is a fragmentary cross-sectional view, illustrating the means by which the clamp body is affixed to the bed.

Clamp body 43 may be affixed to bed 4 in any appropriate manner. An exemplary way of affixing clamp body 43 to bed 4 is illustrated in FIG. 5. Along its length, clamp body 43 is provided with a plurality of vertical bores 64 in spaced relationship (see also FIG. 2). Each bore 64 has a smaller diameter portion 65, forming a shoulder 66 therebetween. The bed 4 has corresponding bores, one of which is shown at 67, which intersect transverse bores, one of which is shown at 68.

Each bore 64 is provided with a bolt 69, the head of which rests on shoulder 66 and the shank of which extends through clamp body bore 65 and bed bore 67. Each transverse bore 68 is provided with a 0-nut 70, into which the bolts 69 are threadedly engaged to securely mount clamp body 43 to bed 4.

The tooling clamp 7 having been fully described, it will be understood by one skilled in the art that its operation is identical to that described with respect to tooling clamp 6. In FIGS. 3 and 5, the tooling clamp 7 is shown in its normal clamping mode, the tongue **9*b* of die 9 being engaged between clamping bar surface 51 and clamp body surface 45 under the urging of belleville springs 55**.

FIG. 4 illustrates tool clamp 7 in its tool-release mode. High pressure hose 63 has been subjected to hydraulic fluid under pressure through the agency of a valved control means. As a result, hose 63 is expanded, shoving actuating bar 62 and clamping bar bolts against the action of their belleville springs, permitting the clamping bars 48 to achieve their tool-release position. Upon disconnection of hose 63 from the hydraulic fluid under pressure by the valved control means, the parts will return to their normal clamping mode as illustrated in FIG. 3.

Figure 6:
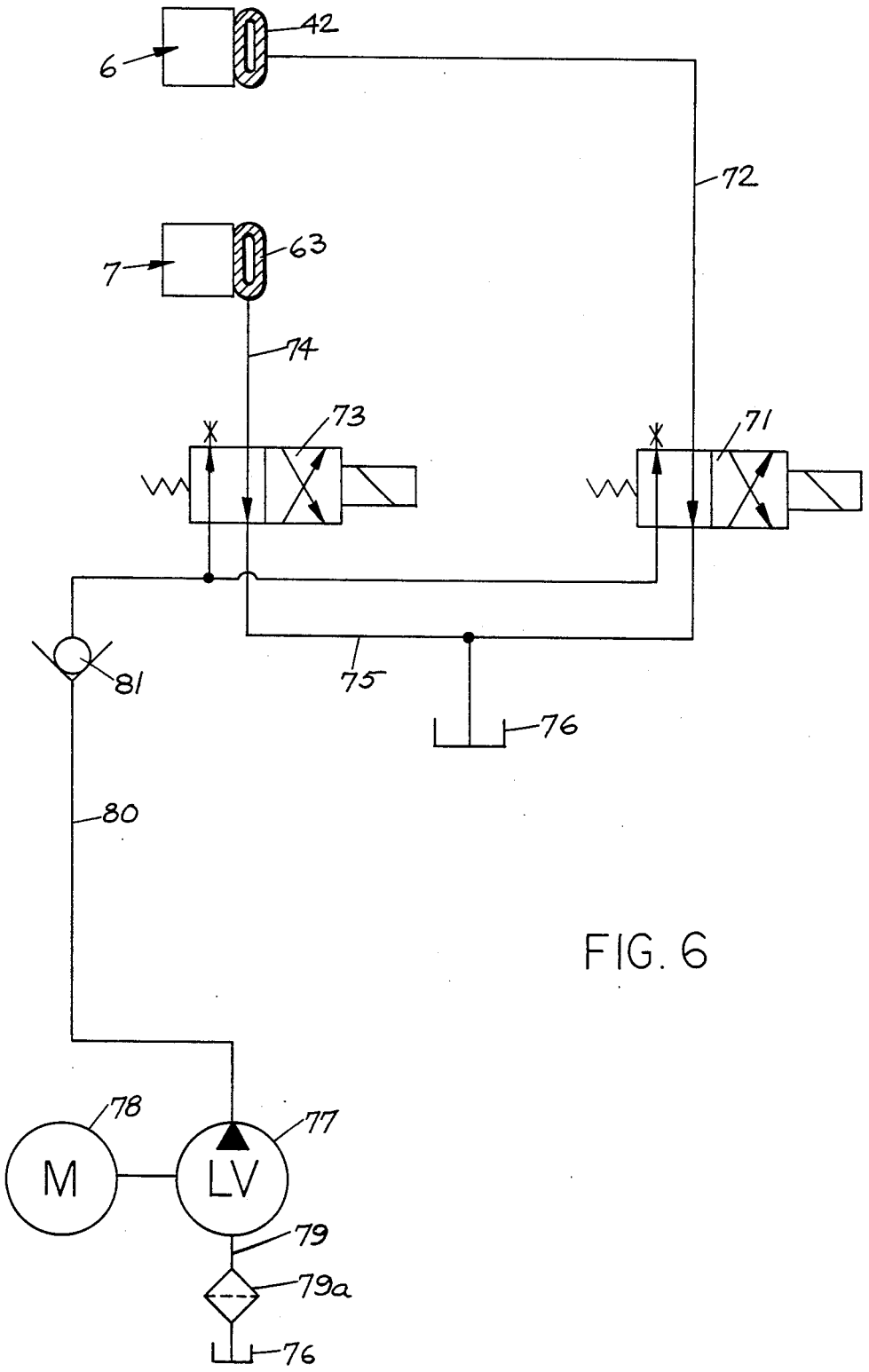
FIG. 6 is a diagrammatic representation of the hydraulic system for the tool clamps of the present invention.

FIG. 6 is a simplified diagrammatic representation of an exemplary hydraulic system for high pressure hoses 42 and 63 of tooling clamps 6 and 7. High pressure hose 42 is connected to a 4-way electric solenoid control valve 71 by a conduit 72. In similar fashion, high pressure hose 63 is connected to 4-way electric solenoid control valve 73 by conduit 74. Control valves 71 and 73 are connected by a conduit 75 to a reservoir 76. In the instance of a hydraulic press brake, the reservoir 76 may be the main hydraulic reservoir of the press brake hydraulic system.

A low volume pump 77 is shown, actuated by a motor 78. The low volume pump 77 is connected by a conduit 79, containing a filter **79*a*, to the reservoir 76. In the usual hydraulic system for a hydraulically actuated press brake, it is normal to provide both a low volume pump and a high volume pump. Low volume pump 77 may be the low volume pump of the overall hydraulic system in such an instance. Low volume pump 77 is connected by a conduit 80, containing a 1-way valve 81, to the control valves 71 and 73, for high pressure hoses 42 and 63**, respectively.

In the diagram of FIG. 6, control valves 71 and 73 are shown in their normal positions. This means that tooling clamps 6 and 7 are in their normal tool-clamping conditions under the influence of belleville springs 35 and 55, respectively. High pressure hoses 42 and 63 are in collapsed condition, being connected by their respective control valves 71 and 73 to conduit 75 and reservoir 76. At the same time, the output line 80 of low volume pump 77 is blocked by the control valves 71 and 73.

When control valves 71 and 73 are energized, they will be shifted to the left, as viewed in FIG. 6. This will result in disconnecting conduits 72 and 74 from conduit 75 and reservoir 76, while at the same time connecting conduits 72 and 74 to the outlet conduit 80 of low volume pump 77. Thus, the high pressure hoses 42 and 63 will be subject to hydraulic pressure and will expand, shifting the tooling clamps 6 and 7 to their unclamping conditions. As a result, tooling associated with clamps 6 and 7 can be removed and replaced. Upon return of the control valves 71 and 73 to their normal positions illustrated in FIG. 6, the high pressure hoses 42 and 63 will again be connected to reservoir 76 and disconnected from the output conduit 80 of low volume pump 77. Under these circumstances, tooling clamps 6 and 7 will return to their normal clamping conditions under the influence of their respective belleville springs 35 and 55.

From the above description, it will be apparent that tooling clamps have been provided for the bed and ram of a press brake and the like which are simple in construction, fool-proof in operation, and enable die removal and replacement to be accomplished quickly, easily and accurately.

Of significance is the fact that the hydraulic system described above is utilized to shift the tooling clamps to their unclamping conditions. As a result of this, hydraulic pressure does not have to be maintained in high pressure hoses 42 and 63 during normal operation of the press brake 1. Furthermore, a failure of the hydraulic system cannot result in the unexpected release of tooling with consequent damage and/or injury. A novel feature of the invention lies in the fact that high pressure hoses 42 and 63 are not used in the usual manner of a hose to transmit hydraulic fluid on its way to do a job, but rather, the high pressure hoses 42 and 63, themselves, constitute the actuating (i.e., unclamping) means for tooling clamps 6 and 7.

Modifications may be made in the invention without departing from the spirit of it.

What is claimed is: position.

1. A pair of tooling clamps for the opposed edges of the ram and bed of a press brake, each tooling clamp comprising a clamp body extending substantially the length of its respective one of said ram and bed, each clamp body having first and second sides and having a clamping surface thereon extending the length of said clamp body and facing away from said second side, a plurality of substantially identical clamping bars each having a clamping surface thereon, said clamping bars being mounted on said first side of said clamp body in end-to-end relationship and with their clamping surfaces opposed to said clamp body clamping surface, each clamping bar being mounted on said clamp body by at least two bolts in parallel spaced relationship and each passing with clearance through a transverse perforation in said clamp body extending through said first and second sides, said clamping bars being shiftable away from said clamp body clamping surface to a release position and toward said clamp body clamping surface to a clamping position, said bolts each having a head at said second side of said clamp body, spring means in association with said bolts normally maintaining said clamping bars in said clamping position, a housing affixed to said second side of said clamp body and extending substantially the length thereof, said housing having a cavity formed therein facing said second side of said clamp body, an actuating bar slidably mounted in said housing cavity and extending substantially the length thereof, a vessel expandable by fluid under pressure located within said cavity and extending substantially the length thereof, said actuating bar having a first side in abutment with said heads of said bolts and a second side in abutment with said expandable vessel, whereby when said vessel is expanded by fluid under pressure, said actuating bar will shift said bolts, thus shifting said clamping bars against the action of said spring means to said release position.

2. The structure claimed in claim 1, wherein said vessel for each of said ram and bed tooling clamps comprises a high pressure hose.

3. The structure claimed in claim 1, wherein said clamp body for said ram comprises an integral one-piece part of said ram.

4. The structure claimed in claim 1, wherein said second side of each of said clamp bodies has annular recesses therein coaxial with said transverse perforations, said spring means in association with each of said bolts comprising a plurality of belleville springs mounted on said bolt within said recess and abutting the base of said recess and said bolt head.

5. The structure claimed in claim 1, wherein in each of said tooling clamps said first side of said clamp body is stepped, having first and second longitudinally extending steps formed therein, said first step being defined by a horizontal surface extending inwardly toward said second side and a vertical surface, a longitudinally extending rounded groove formed in said vertical surface of said first step adjacent its juncture with said horizontal surface of said first step, said second step being defined by a horizontal surface extending inwardly of the upper edge of said vertical surface of said first step toward said second side and a vertical surface extending from said horizontal surface of said second step to the adjacent exterior surface of said clamp body, said vertical surface of said second step comprising said clamp body clamping surface, each of said clamping bars comprising an elongated member having first and second longitudinal sides facing in the same directions, respectively, as said first and second clamp body sides, said clamping bar sides being joined together by first and second longitudinal edges, said first edge of each clamping bar being located adjacent said horizontal surface of said first step, said second side of each of said clamping bars having a longitudinally extending rounded nose adjacent said first edge, said nose being receivable within said rounded groove and comprising a fulcrum for said clamping bar, said second side of each clamping bar having a longitudinally extending lug formed thereon adjacent said second edge, said lug having said clamping bar clamping surface thereon.

6. The structure claimed in claim 2, including a hydraulic circuit comprising a reservoir for hydraulic fluid, a pump having an inlet connected to said reservoir and an outlet, a control valve for said high pressure hose of said ram tooling clamp and a control valve for said high pressure hose of said bed tooling clamp, conduit means connecting each of said hoses to its respective control valve, conduit means connecting said reservoir to both of said control valves and conduit means connecting said pump outlet to both of said control valves, said control valves being shiftable between a first position wherein said high pressure hoses are connected to said reservoir and disconnected from said pump outlet and said clamping bars of said tooling clamps are in their normal clamping position, and a second position wherein said high pressure hoses are connected to said pump outlet and disconnected from said reservoir and said clamping bars of said tooling clamps are in said release position.

7. The structure claimed in claim 5, wherein said second side of each of said clamp bodies has annular recesses therein coaxial with said transverse perforations, said spring means in association with each of said bolts comprising a plurality of belleville springs mounted on said bolt within said recess and abutting the base of said recess and said bolt head.

8. The structure claimed in claim 7, wherein said transverse perforations for said bolts extend through said vertical surface of said first step, said bolts extending with clearance through transverse perforations in said clamping bar and being engaged by nuts located in recesses in said first side of said clamping bar.

9. The structure claimed in claim 8, wherein said vessel for each of said ram and bed tooling clamps comprises a high pressure hose, a hydraulic circuit comprising a reservoir for hydraulic fluid, a pump having an inlet connected to said reservoir and an outlet, a control valve for said high pressure hose of said ram tooling clamp and a control valve for said high pressure hose of said bed tooling clamp, conduit means connecting each of said hoses to its respective control valve, conduit means connecting said reservoir to both of said control valves and conduit means connecting said pump outlet to both of said control valves, said control valves being shiftable between a first position wherein said high pressure hoses are connected to said reservoir and disconnected from said pump outlet and said clamping bars of said tooling clamps are in their normal clamping position, and a second position wherein said high pressure hoses are connected to said pump outlet and disconnected from said reservoir and said clamping bars of said tooling clamps are in said release position.

10. A tooling clamp for one of the opposed edges of the ram and bed of a press brake, said tooling clamp comprising a clamp body extending substantially the length of its respective one of said ram and bed, said clamp body having first and second sides and having a clamping surface thereon extending the length of said clamp body and facing way from said second side, a plurality of substantially identical clamping bars each having a clamping surface thereon, said clamping bars being mounted on said first side of said clamp body in end-to-end relationship and with their clamping surfaces opposed to said clamp body clamping surface, each clamping bar being mounted on said clamp body by at least two bolts in parallel spaced relationship and each passing with clearance through a transverse perforation in said clamp body extending through said first and second sides, said clamping bars being shiftable away from said clamp body clamping surface to a release position and toward said clamp body clamping surface to a clamping position, said bolts each having a head at said second side of said clamp body, spring means in association with said bolts normally maintaining said clamping bars in said clamping position, a housing affixed to said second side of said clamp body and extending substantially the length thereof, said housing having a cavity formed therein facing said second side of said clamp body, an actuating bar slidaby mounted in said housing cavity and extending substantially the length thereof, a vessel expandable by fluid under pressure located within said cavity and extending substantially the length thereof, said actuating bar having a first side in abutment with said heads of said bolts and a second side in abutment with said expandable vessel, whereby when said vessel is expanded by fluid under pressure, said actuating bar will shift said bolts, thus shifting said clamping bars against the action of said spring means to said release position.

* * * * *